US011444367B2

(12) United States Patent
Brockett et al.

(10) Patent No.: US 11,444,367 B2
(45) Date of Patent: Sep. 13, 2022

(54) GLASS-MOUNTED ANTENNA PACKAGE FOR A MOTOR VEHICLE

(71) Applicant: GM GLOBAL TECHNOLOGY OPERATIONS LLC, Detroit, MI (US)

(72) Inventors: Timothy Brockett, Malibu, CA (US); Hyok Jae Song, Oak Park, CA (US); James H. Schaffner, Chatsworth, CA (US); Duane S. Carper, Davison, MI (US); Raymond G. Acker, Clawson, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 16/990,001

(22) Filed: Aug. 11, 2020

(65) Prior Publication Data

US 2022/0052434 A1 Feb. 17, 2022

(51) Int. Cl.

| | |
|---|---|
| ***H01Q 1/24*** | (2006.01) |
| ***H01Q 1/12*** | (2006.01) |
| ***H01Q 9/04*** | (2006.01) |
| ***H01Q 5/50*** | (2015.01) |
| ***H01Q 1/38*** | (2006.01) |

(52) U.S. Cl.

CPC ..... *H01Q 1/1271* (2013.01); *H01Q 1/38* (2013.01); *H01Q 5/50* (2015.01); *H01Q 9/0421* (2013.01)

(58) Field of Classification Search

None

See application file for complete search history.

(56) References Cited

U.S. PATENT DOCUMENTS

| | | | | |
|---|---|---|---|---|
| 2006/0044197 | A1* | 3/2006 | Ikeda | H01Q 1/40 343/713 |
| 2007/0231576 | A1* | 10/2007 | Davis | B32B 7/12 428/412 |
| 2012/0038526 | A1* | 2/2012 | Lim | H01Q 1/38 343/713 |
| 2012/0212366 | A1* | 8/2012 | Alalusi | G01S 13/89 342/118 |
| 2014/0320376 | A1* | 10/2014 | Ozdemir | H01Q 9/0442 343/876 |
| 2017/0324142 | A1* | 11/2017 | Talty | H01Q 1/1271 |
| 2018/0123236 | A1* | 5/2018 | Van Gils | H01Q 9/0414 |
| 2019/0020114 | A1* | 1/2019 | Paulotto | H01Q 9/0442 |
| 2019/0252785 | A1* | 8/2019 | Mcmichael | H01Q 9/0428 |

* cited by examiner

*Primary Examiner* — Trinh V Dinh

(57) ABSTRACT

An antenna assembly configured to be mounted on a glass structure. The antenna assembly comprises a multilayer structure comprising i) a superstrate layer comprising a thin dielectric material; ii) an antenna layer on which the superstrate layer is disposed, the antenna layer comprising an electrically conducting material; and ii) a first substrate layer on which the antenna layer is disposed. The antenna assembly further comprises a housing in which the multilayer structure is disposed. The housing is adapted for attachment to a surface of the glass structure. A dielectric characteristic of the superstrate layer compensates for a dielectric characteristic of the glass structure in order to reduce the variability of the operating frequency of the antenna assembly.

20 Claims, 3 Drawing Sheets

GLASS-MOUNTED ANTENNA PACKAGE FOR A MOTOR VEHICLE

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

For satellite radio applications, a good field of view above the horizon is very important to establish a reliable communication link between the broadcasting sources and the receive antenna. Conventional antennas also must be separated from the windshield glass, the sunroof glass, and other high-dielectric structures. If the antenna is too close to these structures, it may alter the operating characteristics of the antenna and render it inoperable as intended.

Numerous types of radio frequency (RF) antennas are used in vehicles, including antennas mounted on the exterior of a windshield, sharkfin antennas mounted on the roof, dashboard-mounted antennas inside the passenger compartment, and Sirius XM antennas attached to the interior of a windshield by a mechanical mounting arm. A major disadvantage of conventional vehicle antennas is that the antennas do not have a low profile. Most vehicle antennas protrude from a base, forcing the antennas to stick out and break the profile of the vehicle, the glass, or the dashboard. This can detract from the aesthetics of the vehicle, both on the exterior and interior.

SUMMARY

It is an object of the present disclosure to provide an antenna assembly configured to be mounted on a glass structure, which can be on the side internal to the vehicle. The antenna assembly comprises: i) a multilayer structure comprising: a) a superstrate layer comprising a thin dielectric material; b) an antenna layer on which the superstrate layer is disposed, the antenna layer comprising an electrically conducting material; and c) a first substrate layer on which the antenna layer is disposed. The antenna assembly further comprises ii) a housing in which the multilayer structure is disposed. The housing is adapted for attachment to a surface of the glass structure. A dielectric characteristic of the superstrate layer compensates for a dielectric characteristic of the glass structure in order to reduce the variability of the operating frequency of the antenna assembly.

In one embodiment, the first substrate layer comprises a first surface and a second surface opposite the first surface, wherein the antenna layer is disposed on the first surface of the first substrate layer.

In another embodiment, the antenna assembly further comprises a ground plane disposed on the second surface of the first substrate layer.

In still another embodiment, the antenna assembly further comprises a second substrate layer disposed on the ground plane.

In yet another embodiment, the second substrate layer comprises a first surface and a second surface opposite the first surface and wherein the first surface of the second substrate layer is disposed on the ground plane.

In a further embodiment, the antenna assembly further comprises a plurality of electronic components mounted on the second surface of the second substrate layer.

In a still further embodiment, the second substrate layer comprises a plurality of conductive vias connecting the second surface the second substrate layer to the ground plane.

In a yet further embodiment, the second substrate layer further comprises an RF connector configured to connect a feed cable to the antenna assembly.

In one embodiment, the antenna assembly further comprises a metal conductor that passes through the second substrate layer, the ground plane, and the first substrate layer, wherein the metal conductor connects the feed cable to the antenna layer and impedance matches the antenna layer to the feed cable.

In another embodiment, the antenna layer comprises a truncated corner patch antenna.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

This present disclosure introduces a planar circular polarized antenna assembly that is able to transmit and receive effectively through a glass structure that is placed in the near field of the antenna. The antenna assembly includes features that provide operational stability and support additional functionality.

The antenna assembly includes a superstrate layer disposed between the rest of the antenna assembly and the glass structure and provides a uniform dielectric interface to reduce the variability of the operational frequency. The antenna assembly includes an additional substrate layer below the antenna (i.e., away from the glass) that shares a common ground plane and provides a place to mount radio frequency (RF) connectors and additional electronic circuits (e.g., a Low-Noise Amplifier, a matching circuit, etc.) that support the operation of the antenna.

The antenna assembly also includes a low-profile housing that contains the antenna and functions as a mounting structure to attach to the glass structure. The housing positions and configures the antenna snugly against the glass surface and provides visual concealment of the antenna and electronics for aesthetic purposes. Thus, the disclosed antenna assembly is directly adjacent to the glass and operates as intended, providing an opportunity to reduce the profile of the antenna, improve the aesthetics, and maintain its operating characteristics and performance.

The structures shown in FIG. 1, FIG. 2, and FIG. 3 below are not drawn to scale, including the relative lengths, widths, and thicknesses of the structures. The dimensions listed below are by way of example only and should not be construed to limit the scope of the disclosure.

Figure 1:
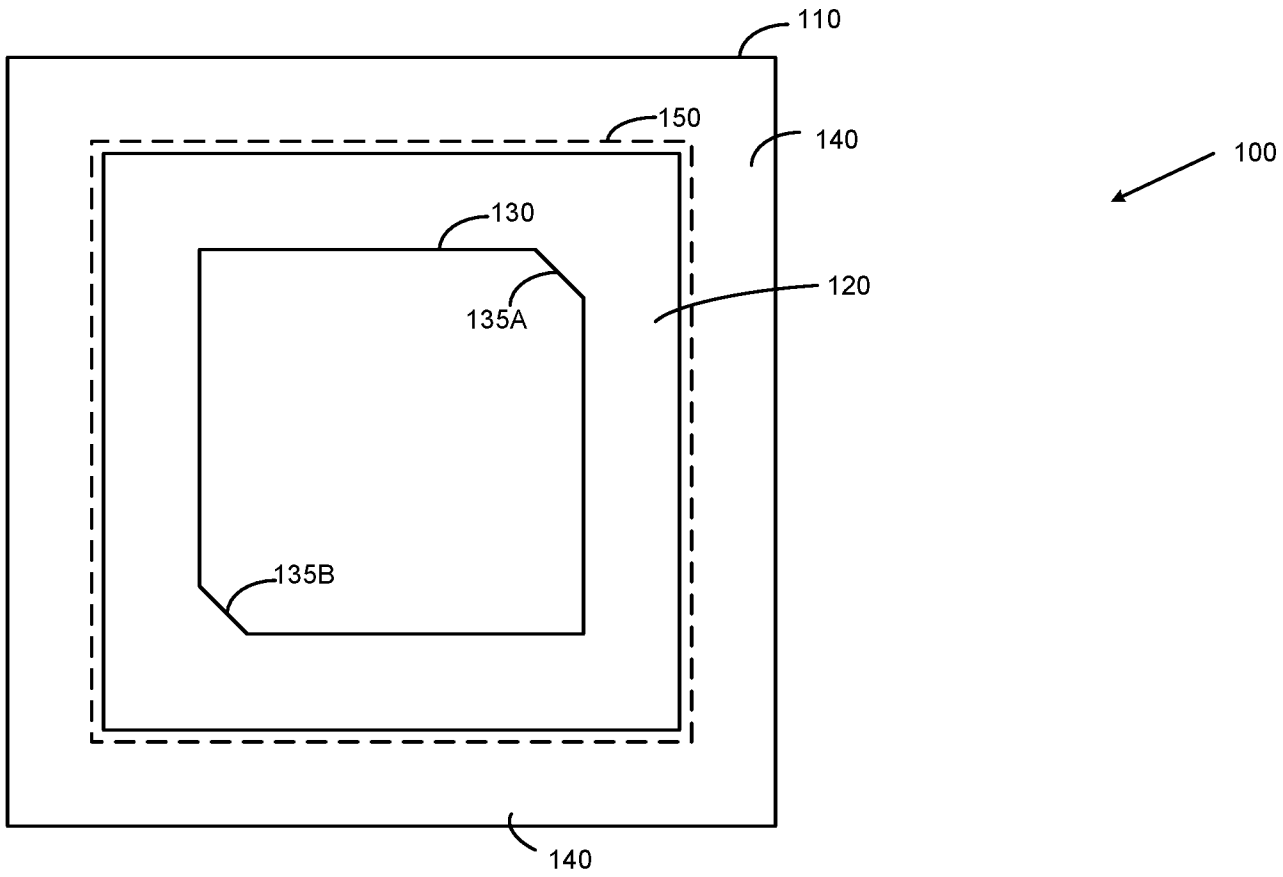
FIG. 1 is a top view of an antenna assembly according to an embodiment of the present disclosure.

FIG. 1 is a top view of an antenna assembly 100 according to an embodiment of the present disclosure. The antenna assembly 100 includes a housing 110, a substrate 120 and a truncated corner patch antenna 130. The housing 110 may be, for example, a plastic shell that contains and protects the other components of the antenna assembly 100. An outer perimeter area of the housing 110 comprises a surface 140 that mounts on a glass structure, such as the inner surface of the sunroof of a vehicle. For example, the surface 140 may attach to the glass structure by adhesives.

An inner region of the housing 110 comprises a cavity 150 (indicated by dotted line) that holds the other components of the antenna assembly 100, including the substrate 120 and the patch antenna 130. When the housing 110 attaches to the inner surface of the glass structure, the upper surface of the patch antenna 130 is in close proximity to the inner surface of the glass structure.

The patch antenna 130 is made of electrically conducting material, such as, but not limited to, copper, gold, silver, and the like. The antenna assembly 100 also comprises a superstrate, a first substrate, and a second substrate (or sub-substrate) explained below in FIG. 2. The substrate may be made of dielectric material, such as FR-4, Rogers Corporation Duroid®, or a similar laminate. The corner patch antenna 130 connects to a metal conductor (or pin) that is cylindrical and impedance matches the antenna to the feed cable. An RF connector is mounted within the sub-substrate and is connected to the antenna feed pin.

In the preferred embodiment, the truncated corner patch 130 is square-shaped with dimensions 29 mm by 29 mm, with two triangular cutouts 135A and 135B on opposite corners. The two cutouts 135A and 135B are the same dimensions, wherein the base of each triangle is 6.15 mm long and the height of each triangle is 6.15 mm long. Depending on which two corners include the cutouts 135A and 135B, the patch antenna 130 may operate in left-handed circular polarized mode or in right-handed circular polarized mode.

Figure 2:
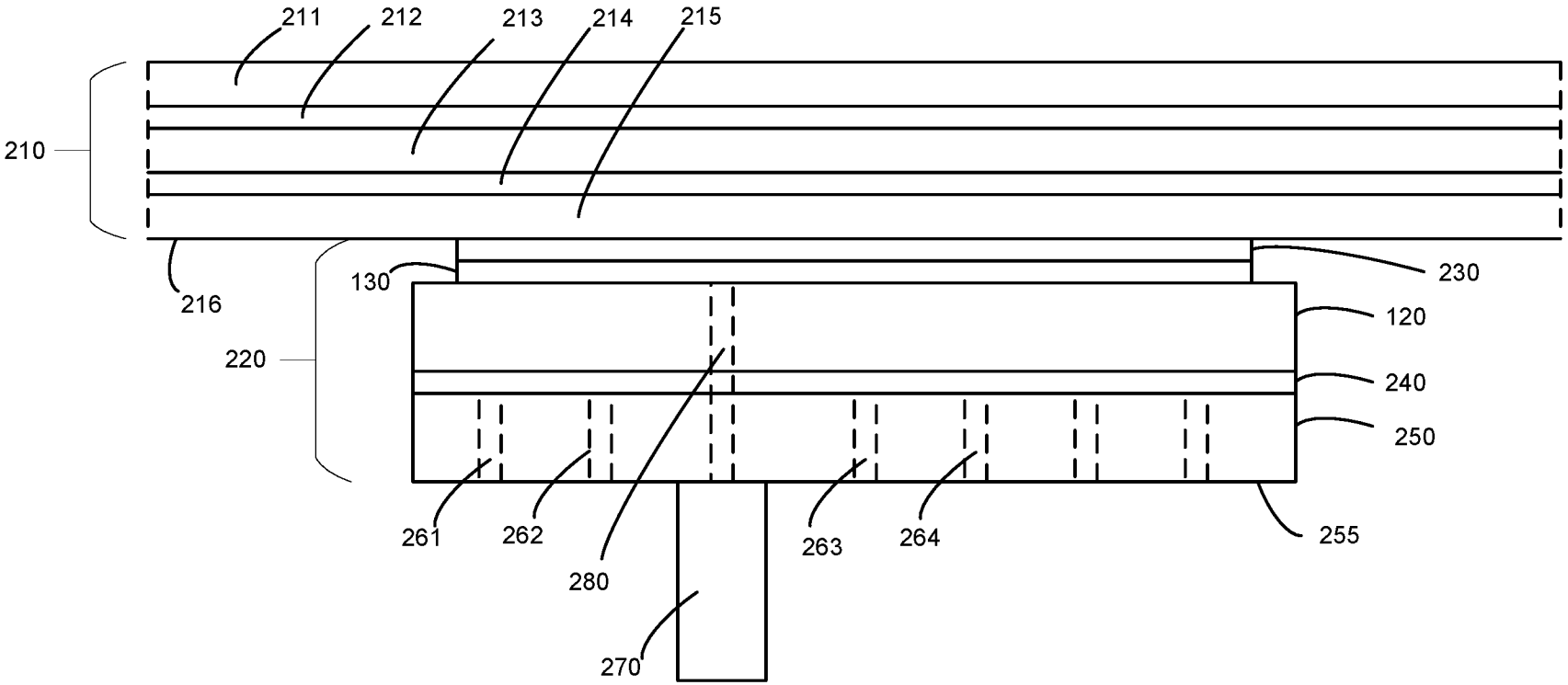
FIG. 2 is a side view of portions of the antenna assembly mounted on a glass structure according to an embodiment of the present disclosure.

FIG. 2 is a side view of portions of the antenna assembly 100 mounted on a glass structure 210 according to an embodiment of the present disclosure. The glass structure 210 comprise five layers, including an exterior glass layer 211, a first PVB layer 212, a suspended particle device (SPD) layer 213, a second PVB layer 214, and an interior glass layer 215 having an inner surface 216. The PVB layers 212 and 214 are polyvinyl butyral is a resin that provides strong binding, optical clarity, and adhesion to many surfaces. The major application of PVB is laminated safety glass for vehicle windshields and sunroofs. The SPD layer 213 is a glass or glazing whose light transmission properties change when voltage, light, or heat is applied.

The antenna assembly 100 includes a multilayer structure 220 that is disposed within housing 110 (not shown in FIG. 2). The multilayer structure 220 comprises a superstrate layer 230, the truncated corner patch antenna 130, a first substrate layer 120, a ground plane 240, and a second substrate layer (or sub-substrate) 250.

The superstrate layer 230 has a first surface and an opposite second surface. The first surface of the superstrate layer 230 is disposed proximate the inner surface 216 of the interior glass layer 215 when the antenna assembly 100 is mounted on the glass structure 210. The superstrate layer 230 is a thin dielectric material that provides a uniform dielectric interface to reduce the variability of the operating frequency of the antenna assembly 100. By way of example, if the antenna assembly 100 is a Sirius XM system having an operating frequency of 2.34 GHz, the dielectric characteristic of the superstrate layer 230 compensates for the dielectric characteristic of the glass structure 210 when the antenna assembly 100 is in the near field of the patch antenna 130. Therefore, when the antenna assembly 100 is mounted on the glass structure 210, the superstrate layer 230 maintains the 2.34 GHz operating frequency of the antenna assembly 100.

The first substrate layer 120 has a first surface and an opposite second surface. The first surface of the first substrate layer 120 is disposed proximate the second surface of the superstrate layer 230. The second surface of the first substrate layer 120 is covered by the ground plane 240.

The second substrate layer 250 has a first surface and an opposite second surface (or bottom surface) 255. The first surface of the second substrate layer 250 is disposed proximate the ground plane 240. The second surface 255 of the second substrate layer 250 may include additional electronic components (not shown) mounted thereon, such as a low-noise amplifier (LNA), a matching circuit and the like that support the operation of the patch antenna 130.

In an exemplary embodiment, the dimensions of the superstrate layer 230, the first substrate layer 120, the ground plane 140, and the second substrate layer 250 may be, for example, 42.5 mm by 42.5 mm. The thickness of the superstrate layer 230 may be 0.254 mm, the thickness of the first substrate layer 120 may be 3.175 mm, and the thickness of the second substrate layer 250 may be 3.175 mm. An antenna conductor (or feed pin) 280 may be positioned from the center 8.5 mm towards one edge of the patch antenna 130. The antenna conductor 280 (shown as a dotted line within multilayer structure 220) connects to a Fakra RF connector, which connects to a feed cable 270.

The second substrate layer 250 comprises a plurality of vias therethrough, including exemplary vias 261-264. The vias 261-264 are coupled between the ground plane 240 of the first substrate layer 120 and an exterior ground connection on the second (or bottom) surface 255 of the second substrate layer 250.

Figure 3:
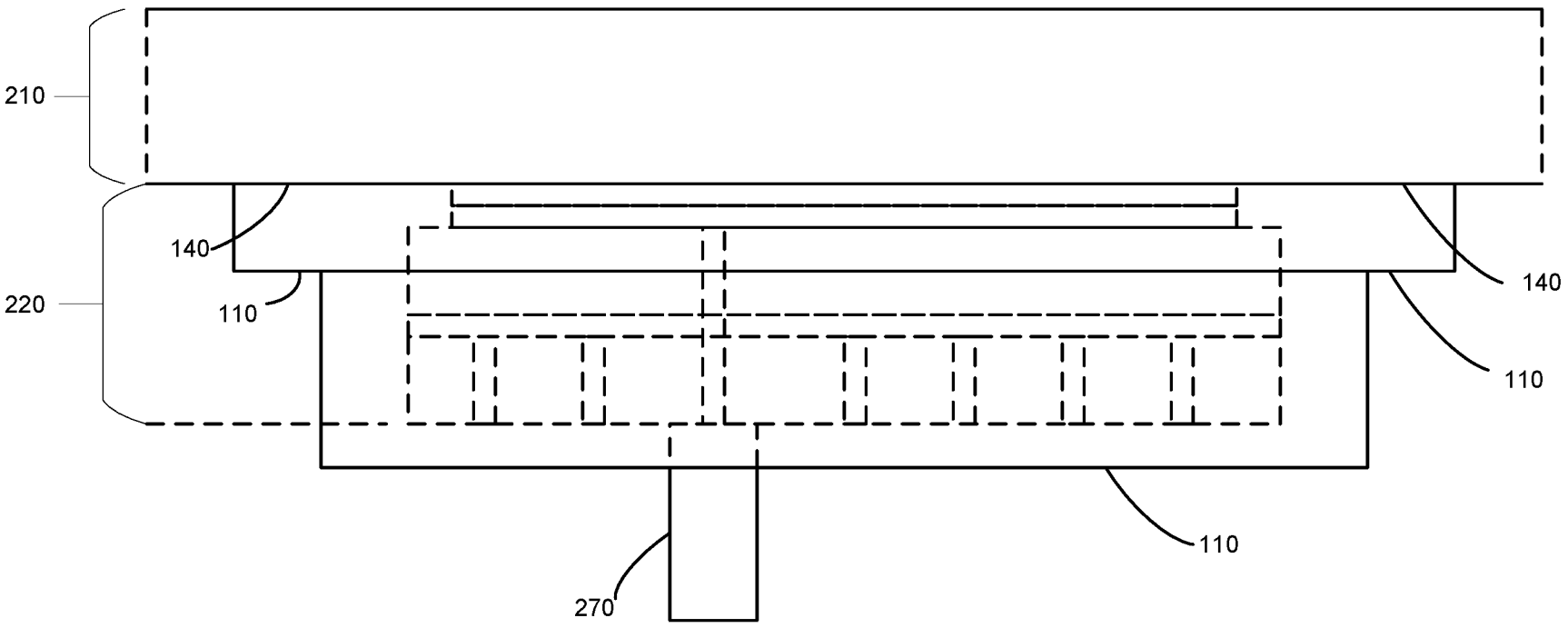
FIG. 3 is a side view of the antenna assembly according to an embodiment of the present disclosure.

FIG. 3 is a side view of the antenna assembly 100 according to an embodiment of the present disclosure. For simplicity, the different internal layers of the glass structure 210 are not shown. The components of the multilayer structure 220 are disposed in the cavity 150 inside the housing 110 and are shown using dotted lines. The housing 110 is shown using solid lines. The surface 140 of the outer perimeter area of the housing 110 is mounted to the glass structure 110 using an adhesive. When mounted, the housing 110 holds the superstrate layer 230 in contact with, or in very close proximity to, the inner surface 216 of the glass structure 210.

The disclosed antenna assembly 100 enables an antenna 130 to be in close proximity to the glass 210 of the windshield or the sunroof within the interior of a vehicle. The antenna assembly 100 advantages include effective transmission and reception of RF signals through a dielectric or glass structure, despite being in the near field of the antenna and impedance loading the antenna. The advantages also include a low-profile compact design that supports the antenna, the RF connector, and additional electronics in a package that is less conspicuous and improves vehicle interior aesthetics. The advantages further include a superstrate layer 230 that mitigates performance variability and provides a more uniform impedance load on the front surface of the patch antenna 130. If the glass structure 210 has an infrared (IR) coating layer, the IR coating layer may include a cutout that permits the antenna radiation through the IR coating in the glass. The cutout (known as a radiation window) would be situated between major layers of the glass and acts as a radiating aperture in the conductive IR coating layer that is acting as a ground plane.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

What is claimed is:

1. An antenna assembly configured to be mounted on a glass structure comprising:

a multilayer structure comprising a superstrate layer formed of a dielectric material having at least one of a uniform structure or a thickness such that the superstrate layer compensates for a dielectric characteristic of the glass structure and reduces variability of an operating frequency of the antenna assembly, the thickness being less than a thickness of a glass layer of the glass structure, an antenna layer on which the superstrate layer is disposed, the antenna layer comprising an electrically conducting material, and a first substrate layer on which the antenna layer is disposed; and a housing in which the multilayer structure is disposed, the housing configured to be attached to a surface of the glass structure.

2. The antenna assembly of claim 1, wherein:

the first substrate layer comprises a first surface and a second surface opposite the first surface; and the antenna layer is disposed on the first surface of the first substrate layer.

3. The antenna assembly of claim 2, further comprising a ground plane disposed on the second surface of the first substrate layer.

4. The antenna assembly of claim 3, further comprising a second substrate layer disposed on the ground plane.

5. The antenna assembly of claim 4, wherein the second substrate layer is configured for a plurality of electronic components to be mounted on the second substrate layer.

6. The antenna assembly of claim 5, wherein the second substrate layer comprises a plurality of conductive vias connecting a surface of the second substrate layer to the ground plane.

7. The antenna assembly of claim 6, wherein the second substrate layer further comprises an RF connector configured to connect a feed cable to the antenna assembly.

8. The antenna assembly of claim 7, further comprising a metal conductor that passes through the second substrate layer, the ground plane, and the first substrate layer, the metal conductor connecting the feed cable to the antenna layer and impedance matching the antenna layer to the feed cable.

9. The antenna assembly of claim 8, wherein the antenna layer comprises a truncated corner patch antenna.

10. The antenna assembly of claim 9, wherein the truncated corner patch antenna is a circular polarized antenna.

11. The antenna assembly of claim 8, wherein:

the antenna layer comprises a patch antenna;

the metal conductor is offset from a center of the patch antenna; and an end of the metal conductor contacts the patch antenna.

12. The antenna assembly of claim 1, wherein the superstrate layer maintains the operating frequency of the antenna assembly at 2.3 giga-hertz.

13. The antenna assembly of claim 1, wherein the superstrate layer is 0.254 millimeters thick.

14. The antenna assembly of claim 1, wherein:

the multilayer structure further comprises a ground plane on which the first substrate layer is disposed, and a second substrate layer on which the ground plane is disposed;

the first substrate layer is 3.175 millimeters thick; and the second substrate layer is 3.175 millimeters thick.

15. The antenna assembly of claim 1, wherein:

the antenna layer comprises a patch antenna; and the patch antenna contacts the superstrate layer.

16. The antenna assembly of claim 1, wherein the housing has an open side facing the glass structure and allows the superstrate layer to contact the glass structure when the housing is mounted on the glass structure.

17. A window assembly comprising:

the antenna assembly of claim 1; and the glass structure comprising a first glass layer, wherein the housing is mounted on the first glass layer and has an opening facing the first glass layer, and the superstrate layer contacts the first glass layer in the opening of the housing.

18. The window assembly of claim 17, wherein:

the antenna layer comprises a patch antenna;

the glass structure comprises a plurality of glass layers and an infrared layer;

the infrared layer comprises a radiation cutout adjacent to and facing the patch antenna; and the patch antenna is configured to receive a radio frequency signal through the radiation cutout of the infrared layer.

19. An antenna assembly configured to be mounted on a glass structure comprising:

a multilayer structure comprising a first substrate, a truncated corner patch antenna that is circular polarized and disposed on the first substrate and comprising an electrically conductive material; and a superstrate layer disposed on the truncated corner patch antenna and formed of a dielectric material, wherein the dielectric material has at least one of a uniform structure or a thickness such that the superstrate layer compensates for a dielectric characteristic of the glass structure and reduces variability of an operating frequency of the antenna assembly, the thickness being less than a thickness of a glass layer of the glass structure; and a housing in which the multilayer structure is disposed, the housing configured to be attached to a surface of the glass structure.

20. The antenna assembly of claim 19, wherein the housing has an open side facing the glass structure and allows the superstrate layer to contact the glass structure when the housing is mounted on the glass structure.

* * * * *